United States Patent [19]

Tuttle, Jr. et al.

[11] Patent Number: 4,749,417

[45] Date of Patent: Jun. 7, 1988

[54] CORROSION RESISTANT COATING

[75] Inventors: James N. Tuttle, Jr., Litchfield; Olyn P. Jaboin, Wolcott, both of Conn.

[73] Assignee: The Lea Manufacturing Company, Waterbury, Conn.

[21] Appl. No.: 33,676

[22] Filed: Apr. 3, 1987

Related U.S. Application Data

[62] Division of Ser. No. 06/861,834, May 12, 1986, Pat. No. 4,673,445.

[51] Int. Cl.[4] ..... C23C 22/82

[52] U.S. Cl. ..... 148/6.15 R; 148/6.15 Z; 428/472.3

[58] Field of Search ..... 148/6.15 R, 6.15 Z, 148/31.5

[56] References Cited

U.S. PATENT DOCUMENTS

| | | | |
|---|---|---|---|
| 2,164,042 | 6/1939 | Ronig | 148/6.14 R |
| 2,326,309 | 8/1943 | Ronig | 148/6.14 R |
| 2,351,605 | 6/1944 | Gibson | 148/6.14 R |
| 2,478,954 | 8/1949 | Tuttle | 148/6.14 R |
| 3,118,792 | 1/1964 | Tuttle | 148/6.14 R |
| 4,168,983 | 9/1979 | Vittands | 148/6.14 R |

*Primary Examiner*—Sam Silverberg

*Attorney, Agent, or Firm*—Robert L. Goldberg

[57] ABSTRACT

A process for improving the corrosion resistance of an iron or steel part having a phosphate conversion coating, said method comprising contact of said part with a solution containing ions selected from the group of cobalt ions and nickel ions. Preferably, the solution also contains stannous ions. Contact may be by immersion or spraying.

14 Claims, No Drawings

CORROSION RESISTANT COATING

This is a divisional of co-pending application Ser. No. 06/861,834 filed on May 12, 1986, now U.S. Pat. No. 4,673,445.

BACKGROUND OF THE INVENTION

I. Introduction

This invention relates to an improved corrosion resistant phosphate coating for parts fabricated from iron and steel.

2. Description of the Prior Art

As is known the in the art, phosphate coatings are conversion coatings for iron and steel. The coatings serve as a base for organic coatings to improve wear resistance and/or impart color to the base metal and to provide corrosion resistance to the base metal. For the most part, the coatings are mixed phosphates of the metals comprising the phosphating solution (the primary metal) and of iron from the base metal. Formation of a phosphate coating is by contact of the base metal with a phosphating composition for a time and at a temperature necessary to provide a coating of the desired thickness. Methods and compositions for phosphating are well known and disclosed in numerous publications including, for example, the *Forty-Fourth Annual Edition of the Metal Finishing Guidebook and Directory,* Metal and Plastics Publications, Inc., Hackensack, N.Y. 1976, pages 554 to 566; Burns and Bradley, *Protective Coatings for Metals,* Reinhold 1967, Third Edition, pages 568 through 575; and U.S. Pat. Nos. 2,164,042; 2,326,309; 2,351,605; 3,118,792 and 4,168,983, all incorporated by reference.

Compositions for phosphating a surface typically comprise a dilute aqueous acidic solution of a metal phosphate formed by the dissolution of a primary metal salt in phosphoric acid, phosphoric acid and an oxidizing agent as an accelerator. The metal salt dissolved in the phosphoric acid is most often zinc oxide with the formation of a primary zinc phosphate coating, but salts of manganese and iron are often used either alone or in combination with the zinc oxide. The phosphate coating is formed by free phosphoric acid attacking the metal surface liberating iron which goes into solution thus providing iron phosphate in solution in addition to the primary metal phosphates. At the interface of a base metal surface and the solution, the pH is altered resulting in the insolubilization of the phosphates and precipitation of the same on the surface of the base metal forming the conversion coating. An overall reaction for formation of the coating can be written as follows using zinc as illustrative of the primary metal in the solution:

$$3Zn(H_2PO_4)_2+Fe+4H_2O \rightarrow Zn_3(PO_4)_2.4H_2O + FeHPO_4+3H_3PO_4+3H_3PO_4+H_2$$

The combination of zinc and iron phosphates in the above equation represent the phosphate coating.

Though phosphate coatings have been used for many years to improve corrosion resistance of a part formed from iron or steel, further improvements are desired. One such improvement known to the art involves use of a secondary treatment solution. For example, it is known to treat a phosphate coated surface with an aqueous solution of a stannous salt which is water soluble and water stable. A preferred solution comprises an aqueous solution of stannous chloride as disclosed in U.S. Pat. No. 2,478,954. An improvement in the method disclosed in U.S. Pat. No. 2,478,954 is disclosed in U.S. Pat. No. 3,118,792 where corrosion resistance is further improved by immersion of a sheet of lead in the stannous salt solution which is believed to be a source of lead chloride formed by neutralization of hydrochloric acid formed during reaction. Other improvements to corrosion resistance imparted by phosphating solution are accomplished by additives in the primary phosphate solution. One such additive is a cyclic trimeta phosphate as disclosed in U.S. Pat. No. 4,168,983.

Notwithstanding the improvements in the art of phosphating described above, corrosion of iron and steel is a major problem and further improvements are desired.

SUMMARY OF THE INVENTION

The subject invention is a method for markedly increasing the corrosion resistance of iron or steel parts. In accordance with the invention, an iron or steel part is treated with a phosphating solution to form a phosphate conversion coating. The formation of the phosphate coating is in accordance with prior art methods. Following formation of the phosphate coating, the part is post treated with an aqueous solution of a nickel or cobalt salt. In addition to the nickel or cobalt salt, the post treatment solution may also include a stannous salt with or without the presence of lead to further improve corrosion resistance.

By the process of the invention, the corrosion resistance of an iron or steel part is significantly improved. A conventional test for corrosion resistance is the salt spray test in accordance with ASTM standard B-117. With a conventional phosphate coating, part spray resistance of a part having a phosphate conversion coating weighing between about 1,000 and 3,000 milligrams per square foot is approximately from 2 to 6 hours. The same part treated in accordance with the invention would have a salt spray resistance at least double this and typically in excess of 100 hours.

DESCRIPTION OF THE PREFERRED EMBODIMENTS

In carrying out the process of this invention, a suitable iron or steel part is first treated to provide a phosphate conversion coating thereon. The primary metal of the phosphating composition is preferably zinc. Manganese may be used alone or in admixture with the zinc, but manganese alone has been found to produce results inferior to the results obtained with zinc. Combinations of the metals may be used such as zinc-calcium combinations or zinc-calcium-manganese combinations. The concentration of the primary metal within the phosphating solution may vary within a broad range, as is known in the art, dependent upon how heavy a coating is desired. Typically, the concentration varies from about 0.1 to 3.0 moles per liter, the higher concentrations providing heavier coatings—i.e., 1,000 or more milligrams of coating per square foot.

Phosphoric acid is used as a source of acidity and as a source of phosphate to form phosphates of the primary metal and dissolved iron. Its concentration can also vary within wide limits, again dependent upon the weight of desired coating. Typically, the concentration of the phosphoric acid ranges from about 1.0 to 8.0 moles per liter. As a guideline only, it is conveniently used in amounts slightly in excess of that necessary to maintain phosphate dissolved in solution.

To increase the rate of the phosphating reaction and to inhibit the build up of ferrous irons in solution, it is customary to include an oxidizing agent in the phosphating solution referred to in the art as an accelerator. Typical accelerators include salts of nitrites, chlorates, and peroxides and oxidizing acids such as nitric and perchloric acids. Other materials have been proposed as accelerators including (1) reducing agents such as sulfites and hydroxylamines, (2) organic compounds such as quinoline, toluidine, and nitro phenols, and (3) heavy metals such as copper, nickel and chromium. Only the oxidizing agents have achieved major industrial importance as accelerators.

As is known in the art, other additives may be included in the phosphating solution such as pH adjustors, levelers and the like. A preferred addititive in accordance with the invention is a cyclic trimeta phosphate as disclosed in the above cited U.S. Pat. No. 4,168,983. The concentration of the trimeta phosphate is preferably maintained low, 0.001 moles per liter providing some benefit and increasing amounts providing increased benefits up to a maximum of about 0.15 moles per liter. A preferred range varies between 0.01 and 0.1 moles per liter. As the concentration increases above 0.15 moles per liter, corrosion resistance drops off but then increases as the concentration reaches about 0.25 moles per liter. Consequently, higher concentrations may be used but are less preferred because of cost and further, at the higher concentration, results are not easily reproducible and the good results are obtainable only with relatively fresh solutions. Any iron or steel part to which a phosphating coating has been applied in the prior art may be treated in accordance with the invention. The part is prepared in accordance with prior art procedures and then immersed in a phosphating composition as described above, typically at a temperature varying between about 150° and 200° Fahrenheit, for a time sufficient to yield a coating of the desired thickness.

Following formation of a phosphate conversion coating, and preferably a chrome-free water rinse, the part is treated with a solution containing a dissolved nickel or cobalt salt whereby the corrosion resistance of the part is significantly improved. Cobalt salts provide significantly better results than nickel salts, though nickel salts provide some benefit. Of the salts of nickel and cobalt, acetates and chlorides provide best results with acetates being most preferred. The nitrates and sulfates are suitable but the results obtained are significantly inferior to the results obtained with the acetate.

In one embodiment of the invention, a simple aqueous solution of the salt in water is formed. However, other additives may be used in the formulation as would be obvious to one skilled in the art such as pH adjustors, buffers, surfactants, etc.

The concentration of the cobalt or nickel salt in the treatment solution may vary within wide limits, but the salt is generally present in an amount at least sufficient to double the salt spray resistance of the part (using the ASTM B-117 procedure described above) compared to a part that has not been treated with the solution of the cobalt or nickel salt. Preferably, the salt is present in solution in a concentration of from 0.1 to 20% by weight and more preferably, in an amount of from 1 to 4% by weight. For reasons not fully understood, it has been found that as the concentration of the salt in the treatment solution increases from 0 to about 1%, salt spray resistance improves. As the concentration of the salt increases further to between about 1 and 1.5%, salt spray resistance of a part is improved compared to a part that has not been treated, but the resistance is less than that possessed by a part treated with a solution having a lower salt concentration. As the salt concentration increases above 1.5%, salt spray resistance again increases as a function of salt concentration.

A part is treated in the treatment solution of the invention by immersion or spraying of the part with the solution. Preferably, the treatment solution is maintained at elevated temperature, more preferably within the range of from 150° to 200° F. and most preferably, within the range of from about 175° to 190° F. Treatment time may vary from about 1 minute to 30 minutes and preferably varies from about 3 to 10 minutes.

In a second, more preferred embodiment of the invention, the nickel or cobalt salt is combined with a stannous treatment solution. A typical stannous treatment solution is disclosed in U.S. Pat. No. 2,854,367. In accordance with said patent, various water soluble stannous salts are used, though stannous chloride is preferred. A concentrate would combine 1,000 grams or more of stannous chloride dihydrate per liter of solution together with other appropriate ingredients. The treatment solution is prepared by diluting the stannous salt concentrate with water in an amount which may vary from 10 ml to 1,000 ml of the concentrate per liter of treatment solution with a preferred treating solution comprising from 30 to 50 grams of stannous chloride per liter of solution. Thus, the treating solution comprises an aqueous solution of stannous salt in which the stannous salt is present in an amount of from approximately 10 to 1,000 grams per liter of treatment solution.

In addition to a stannous salt in the stannous treatment solution, the solution may further comprise a water soluble aliphatic polyhydroxy acid in an amount of from 0.1 to 20% by weight of the stannous salt. Tartaric acid is a preferred acid. A lead salt may also be present in solution. In accordance with U.S. Pat. No. 3,118,792, in addition to the stannous solution, it is desirable for the treatment solution to also include lead, preferably in the form of sheets, bars or the like suspended in the bath with the surface of the lead exposed to the treatment solution in an amount of approximately 1 square inch per liter of solution. This would maintain the acidity of the bath at a desired level.

In accordance with the preferred embodiment of the invention, the nickel or cobalt salt is added to the stannous treatment solution in the concentration set forth above and the combined stannous-cobalt or nickel salt solution is used under the same conditions as described above for the solution of the nickel or cobalt salt alone.

It is known in the art that salt spray resistance may be improved by immersion of a part in a corrosion preventing oil. Such oils are known to those skilled in the art. If a part treated in accordance with the process of this invention is immersed in a corrosion preventing oil, salt spray resistance may be increased to in excess of 1,000 hours.

The invention will be better understood by reference to the examples which follow wherein the following treatment solutions were used:

| Solution A - Phosphate Treatment Solution | |
|---|---|
| Phosphoric acid (75%) | 380 grams. |
| Nitric acid (67%) | 142 grams. |
| Zinc oxide | 160 grams. |

-continued

| Solution A - Phosphate Treatment Solution | |
|---|---|
| Sodium trimetaphosphate | 3.3 grams. |
| Water | to 1 liter. |

To make an operating bath from the above concentrate, 7.5 parts of the concentrate are diluted with 92.5 parts of water. To simulate a used commercial formulation, 0.7% by weight iron in the form of steel wool is added.

| Solution B - Cobalt Treatment Solution | |
|---|---|
| Cobalt Acetate | 20 grams |
| Surfactant | 2 grams |
| Water | to 1 liter |
| pH | 6.8 |
| **Solution C - Cobalt/Stannous Treatment Solution** | |
| Stannous chloride | 65 grams |
| Cobalt acetate | 5 grams |
| Tartaric acid | 5 grams |
| Water | to 1 liter |

EXAMPLE 1

The following processing sequence was used to prepare a steel test panel of a 1010 alloy:

(a) immerse in hot alkaline cleaner for 10 minutes at 180° Fahrenheit (Cleaner S-9 of Lea Manufacturing);

(b) hot water rinse (about 170° F.);

(c) pickle in 10% by weight hydrochloric acid by immersion for 10 minutes at room temperature;

(d) cold water rinse;

(e) immerse in conditioner of oxalic acid for 1 minute at room temperature;

(f) cold water rinse;

(g) immerse in Solution A maintained at a temperature of 170° Fahrenheit for 20 minutes to provide a phosphate coating having a weight of about 2,000 milligrams per square foot;

(h) cold water rinse;

(i) immerse in Solution B maintained at a temperature of 175° Fahrenheit for 5 minutes;

(j) cold water rinse;

(k) hot water rinse;

(l) dry.

A part treated in accordance with the above procedure was tested for corrosion resistance by salt spray following the procedures of ASTM B-117. The test was continued until failure or 200 hours, whichever was longer. Failure is defined for purposes herein as rust, both on the sharp edges of the part and readily visible over the smooth surfaces. The test involves some subjectivity and there is a possibility of some experimental error. Salt spray resistance was found to be 40 hours.

EXAMPLE 2

The procedure of Example 1 is repeated omitting step (i). Salt spray resistance was found to be 4 hours.

EXAMPLE 3

The procedure of Example 1 is repeated substituting Solution C for Solution B in step (i). Salt spray resistance was found to be 120 hours.

EXAMPLE 4

The procedure of Example 3 is repeated including a step of immersion of the treated part in a corrosion preventive oil identified as Lea 571 Drying Oil available from Lea Manufacturing Company of Waterbury, Conn. Salt spray resistance was found to be in excess of 1,000 hours.

EXAMPLE 5

The procedure of Example 1 is repeated substituting nickel acetate for cobalt acetate in Solution C in step (i). Salt spray resistance was found to be 8 hours.

The results obtained in Examples 1 through 5 are tabulated as follows:

| Example No. | Invention Solution | Salt Spray (hours) |
|---|---|---|
| 1 | None | 4 |
| 2 | Cobalt Acetate | 40 |
| 3 | Cobalt Acetate/Stannous Chloride | 120 |
| 4 | Example 3 with drying oil | >1,000 |
| 4 | Nickel Acetate/Stannous Chloride | 8 |

EXAMPLE 5

The procedure of Example 3 was repeated substituting steel parts of alloys 1022, 1038 and 1050 for alloy 1010 with similar results obtained.

Examples 3 and 4 above constitute the most preferred embodiments of the invention.

The conversion coating formed using the procedures of this invention contain cobalt in minor amount in the coating. The amount is dependent upon the concentration of the cobalt in the plating solution but it has been found that the concentration can vary between about 0.1 and 1.0 percent by weight of the deposit. Though not wishing to be bound by theory, it is believed that the cobalt increases corrosion resistance through chemical reaction with the conversion coating.

We claim:

1. A process for improving the corrosion resistance of an iron or steel part coated with a phosphate conversion coating, said process comprising the step of contacting the phosphate conversion with a treatment solution comprising an aqueous solution containing stanneous salt and a member selected from the group of nickel salt and cobalt salt said stanneous being salt being in a concentration of between 10 and 1,000 grams per liter of solution and said nickel or cobalt salt being in a concentration of between 1 to 200 grams per liter of solution.

2. The process of claim 1 where the member is a cobalt salt.

3. The process of claim 2 where the member is cobalt acetate.

4. The process of claim 1 where the concentration said nickel or cobalt salt varies between about 1 and 4% by weight.

5. The process of claim 1 where the solution also contains metallic lead.

6. A process for improving the corrosion resistance of an iron or steel part, said process comprising the steps of first forming a phosphate conversion coating over said part by contact of the part with a phosphating solution, and then contacting the phosphate conversion with an aqueous treatment solution comprising an aqueous solution containing stanneous salt and a member selected from the group of nickel salt and cobalt salt said stanneous being salt being in a concentration of between 10 and 1,000 grams per liter of solution and said nickel or cobalt salt being in a concentration of between 1 to 200 grams per liter of solution.

7. The process of claim 6 where the phosphating solution contains zinc phosphate.

8. The process of claim 6 where the phosphating solution contains a cyclic trimeta phosphate.

9. The process of claim 6 where the member is a cobalt salt.

10. The process of claim 9 where the member is cobalt acetate in a concentration of from 1 to 4% by weight of the solution.

11. The process of claim 9 where the cobalt salt is cobalt acetate.

12. The process of claim 6 where the solution also contains metallic lead.

13. An iron or steel part produced according to claims 1, or 6.

14. The part of claim 13 where the cobalt is present in the conversion coating in a concentration of from 0.1 to 1.0% of the coating.

* * * * *